United States Patent [19]

Handschuch et al.

[11] 4,345,356

[45] Aug. 24, 1982

[54] MECHANISM FOR ELIMINATING IMPURITIES FROM FIBROUS MATERIAL, IN PARTICULAR COTTON

[75] Inventors: Karl Handschuch, Gaimersheim; Burkhard Wulfhorst, Ingolstadt; Konrad Gilhaus, Aachen, all of Fed. Rep. of Germany

[73] Assignee: Schubert & Salzer, Ingolstadt, Fed. Rep. of Germany

[21] Appl. No.: 193,163

[22] Filed: Oct. 2, 1980

[30] Foreign Application Priority Data

Oct. 2, 1979 [DE] Fed. Rep. of Germany ..... 2939861

[51] Int. Cl.[3] ..... D01G 9/12; D01G 9/08; D01G 9/16

[52] U.S. Cl. ..... 19/200; 19/105; 19/107; 19/204; 19/205; 19/304

[58] Field of Search ..... 19/105, 107, 200, 202, 19/203, 204, 205, 304–308, 98, 99

[56] References Cited

U.S. PATENT DOCUMENTS

| | | | |
|---|---|---|---|
| 1,368,319 | 2/1921 | Bates | 19/105 |
| 1,478,630 | 12/1923 | Bates | 19/105 |
| 1,953,386 | 4/1934 | Bates | 19/99 |
| 4,135,276 | 1/1979 | Handschuch et al. | 19/200 X |

FOREIGN PATENT DOCUMENTS

| | | | |
|---|---|---|---|
| 2634769 | 2/1978 | Fed. Rep. of Germany | 19/200 |
| 2060012 | 4/1981 | United Kingdom | 19/200 |
| 320567 | 1/1972 | U.S.S.R. | 19/202 |

*Primary Examiner*—Louis Rimrodt

[57] ABSTRACT

A mechanism for eliminating impurities from fibrous material, in particular cotton, having at least two card-clothed rolls (22, 23) arranged after a feed mechanism and a screening drum (3) to which said fibrous material is fed by means of an airstream. A housing closely encloses the two card-clothed rolls. Interposed in the housing are separating openings including separating edges. One of said two card-clothing rolls (23) cooperating with the other of the two card-clothed rolls has a take-off and loosener roll for the fibrous material and the centrifugal forces at the circumference of the second card-clothed roll (23) being greater than at the first card-clothed roll (22). A third card-clothed roll is positioned in carding relation with the first card-clothed roll. Another take-off and loosener roll (52) is positioned for removing fibers from the third card-clothed roll (5). A pair of fiber feed channels (24, 53) extend from the take-off rolls (23, 52) for conveying the fibers therefrom to the screening drum (3). The widths of the mouth of the channels (24, 53) are one-half of the width of the screen drum (3) so that each of the fiber conveying channels (24, 53) feed fiber material to one-half of the screening drum (3).

6 Claims, 1 Drawing Figure

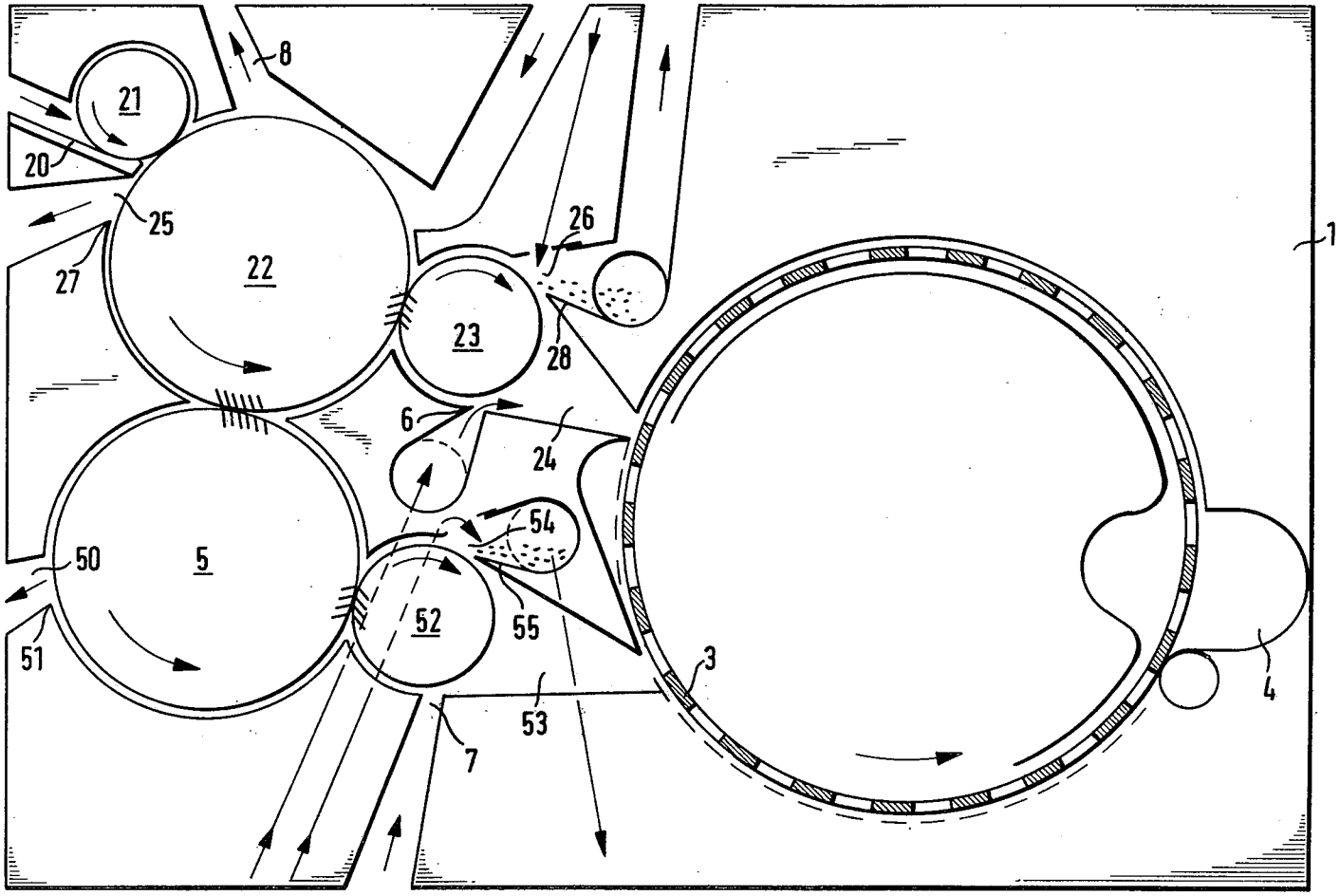
1
4
3
26
28
24
54
55
53
23
6
52
7
8
22
5
21
25
20
27
50
51

MECHANISM FOR ELIMINATING IMPURITIES FROM FIBROUS MATERIAL, IN PARTICULAR COTTON

BACKGROUND OF THE INVENTION

The present invention refers to a mechanism for eliminating impurities from fibrous material, in particular cotton, having at least two card-clothed rolls arranged after a feed mechanism, and a screening drum to which the fibrous material is fed by means of an airstream, where the two card-clothed rolls are closely enclosed by a housing interrupted by separating openings having associated separating edges. The second card-clothed roll cooperates with the first card-clothed roll as a take-off and loosener roll for the fibrous material and the centrifugal forces at the circumference of the second card-clothed roll are greater than at the first card-clothed roll. Associated with the two card-clothed rolls is a third card-clothed roll which is closely enclosed by a housing interrupted by separating openings and is associated in such a way that between the first and the third card-clothed rolls a carding action is exerted upon the fibrous material, in accordance with the Parent Patent (German Patent Application No. P 27 12 650.726).

With this mechanism it is possible in a single cleaning mechanism and with only one passage of the fibrous material, to free the latter of all impurities, in that in individual stages of elimination first of all the coarse, then finer and finally fine and finest impurities get removed from the fibrous material which is loosened down to individual fibers. By the foreseen arrangement of the third card-clothed roll in the way that the fibrous material gets carded between it and the first card-clothed roll and the take-off and loosener roll cooperating with the two carding card-clothed rolls, the flow of material is increased and a still more thorough elimination of coarser impurities is achieved.

But it has been found that in doing this in certain cases neps may form in the fibrous material, the loosening of which on the succeeding machines is only partially possible and which therefore, impair the quality of the yarn produced.

SUMMARY OF THE INVENTION

The object of the present invention is to construct the mechanism in such a way that a fibrous material largely free of neps is obtained and at the same time a further increase in production is achieved.

This problem is solved in accordance with the invention by there being assigned to each of the first card-clothed roll and the third card-clothed roll a take-off and loosener roll.

It is thereby possible to intensify the take-off of the fibrous material from the first and third card-clothed rolls, so that correspondingly few fibers remain on these card-clothed rolls and consequently the risk of nep formation is reduced. Furthermore, this arrangement of the rolls makes it possible to increase the flow of material.

A further reduction in nep formation is achieved by there being associated with the first card-clothed roll a suction channel for the fibers which have remained on it. Advantageously each of the two take-off loosener rolls are connected by its own fiber conveyor channel to the screening drum. An improved delivery of fiber from the take-off and loosener roll into the fiber conveyor channel is made possible by an induction slit close to the point of fiber delivery from the take-off and loosener roll, which extends across the width of it. In order to avoid layering one above the other of the fiber material delivered from the two fiber conveyor channels onto the screening drum, the width of the mouth of each of the two fiber conveyor channels at the screening drum corresponds with half the width of the screening drum and each conveyor channel acts upon one-half of the screening drum. A thorough and rapid take-off of the cleaned fibrous material from the screening drum, requiring little space, results if the device which takes the fibrous material off the screening drum is a suction channel which extends transversely to the direction of rotation of the screening drum.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

BRIEF DESCRIPTION OF THE DRAWING

The FIGURE is a side elevational view of a device constructed in accordance with the invention.

DESCRIPTION OF A PREFERRED EMBODIMENT

The cleaning mechanism arranged in a housing 1 contains a first card-clothed roll 22 revolving counter-clockwise, to which the fibrous material is fed in flock form by means of a feed table 20 and a feed roll 21. After the card-clothed roll 22 is arranged a second smaller card-clothed roll 23 which revolves clockwise at a considerably higher r.p.m. than the card-clothed roll 22 and as indicated by the tips of the card-clothing acts as the take-off and loosener roll. The card-clothed roll 23 is connected by a fiber conveyor channel 24 to a screening drum 3 with which for the take-off of the fibrous material deposited on it there is associated a suction channel 4. The suction channel 4 extends transversely to the direction of rotation of the screening drum 3. The card-clothed rolls 22 and 23 are closely enclosed by the housing 1 or respectively parts of the housing. Separating openings 25 and 26 having associated therewith separating edges 27 and 28 are provided for the escape of impurities in the fiber carried on rolls 22 and 23 which are then carried away pneumatically.

A third card-clothed roll 5 cooperates with the first card-clothed roll 22 and revolves counter-clockwise just like the card-clothed roll 22. Between the two card-clothed rolls carding of the fibrous material is effected. After the card-clothed roll 5 there is likewise arranged a take-off and loosener roll 52, the construction and r.p.m. of which corresponds with the take-off and loosener roll 23. A second fiber conveyor channel 53 connects the roll 52 to the screening drum 3. The card-clothed roll 5 and the take-off and loosener roll 52 are closely enclosed by the housing 1 or respectively parts of the housing. A separating opening 50 having a separating edge 51 is associated with the card-clothed roll 5 and a separating opening 54 having a separating edge 55 is associated with the take-off and loosener roll 52.

Close to the point at which the loosening of the fibers from the take-off and loosener rolls 23 and 52 is effected, induction slits 6 and 7 are provided in the housing 1, which extends across the working width of the two card-clothed rolls. Again, a suction channel 8 is associated with the first card-clothed roll 22 and is connected to a source of reduced pressure (not shown). If necessary such a suction channel may be associated with the other card-clothed rolls too.

In continuous service, the fibrous material fed into the mechanism gets carried by the first card-clothed roll 22 to the carding point where part is transferred to the card-clothed roll 5. Since a take-off and loosener roll is associated with each of the two card-clothed rolls 22 and 5, a thorough take-off of the fibrous material is effected from the card-clothed rolls 22 and 5 with simultaneous loosening into individual fibers. If in spite of this thorough take-off, fibers still get carried back by the card-clothed roll 22 in the direction towards the feed table, but before ever reaching the infeed point where nep formation can occur, they get sucked away through the suction channel 8 by the suction airstream which is carried past the card-clothed roll 22.

The loosening of the fibrous material from the take-off and loosener rolls 23 and 52 is assisted by the suction airstream which because of the reduced pressure prevailing inside the screening drum 3 flows through the induction slits 6 and 7 and the fiber conveyor channels 24 and 53 to the screening drum 3 and in doing so brushes past the card-clothing of the take-off and loosener rolls.

Advantageously the deposit upon the screening drum 3, of the fibrous material loosened into individual fibers and freed at the separating openings in stages of coarse and finer impurities, is effected in such a way that each of the two fiber conveyor channels 24 and 53 delivers fibrous material respectively to one-half of the screening drum. For doing this the mouth of each fiber conveyor channel is reduced to half the width of the screening drum. The fibrous material cleaned on the screening drum 3 of the finest foreign bodies, subsequently gets sucked away transversely to the direction of rotation of the screening drum 3 through the suction channel 4. A thorough removal of the fibrous material is thereby effected, so that a clean area of the suction drum always arrives at the fiber conveyor channels.

While a preferred embodiment of the invention has been described using specific terms, such description is for illustrative purposes only, and it is to be understood that changes and variations may be made without departing from the spirit or scope of the following claims.

What is claimed is:

1. A mechanism for eliminating impurities from fibrous material in particular cotton, having at least two card-clothed rolls (22, 23) arranged after a feed mechanism, and a screening drum to which said fibrous material is fed by means of an airstream, a housing closely enclosing said two card-clothed rolls, said housing having separating openings including separating edges provided therein, a second (23) of said two card-clothed rolls cooperating with a first of said two card-clothed rolls as a take-off and loosener roll for said fibrous material and the centrifugal forces at the circumference of said second card-clothed roll being greater than at said first card-clothed roll, a third card-clothed roll closely enclosed by a housing interrupted by separating openings, said third card-clothed roll being positioned in carding relation with said first card-clothed roll, said mechanism comprising:

a take-off and loosener roll (52) positioned for removing fibers from said third card-clothed roll (5).

2. The mechanism as set forth in claim 1 further comprising:

a suction channel means (8) associated with said first card-clothed roll (22) for removing fibers remaining on said first card-clothed roll (22) after engaging said second card-clothed roll.

3. The mechanism as set forth in claim 1 further comprising:

a fiber conveyor channel (24, 53) provided between each of said take-off and loosener rolls (23, 52) and said screening drum.

4. The mechanism as set forth in claim 3 further comprising:

said fiber conveyor channels (24, 54) having a mouth positioned adjacent said screening drum (3) which have widths which correspond with half the width of said screening drum (3) and each of said fiber conveyor channels (24, 53) feeding fiber material to one-half of said screening drum (3).

5. The mechanism as set forth in claim 4 further comprising:

a suction channel means (4) extending transversely to the direction of rotation of said screening drum (3) for removing fibrous material from said screening drum (3).

6. The mechanism as set forth in claim 1 further comprising:

air induction slits (6, 7) carried close to the point of fiber delivery from said take-off and loosener rolls (23, 52) respectively, said slits extending across the width of said rolls (23, 52).

* * * * *